US005839730A

United States Patent [19]

Pike

[11] Patent Number: 5,839,730

[45] **Date of Patent: *Nov. 24, 1998**

[54] CONSECUTIVE CARD SIDE BET METHOD

[75] Inventor: Russell C. Pike, Las Vegas, Nev.

[73] Assignee: Shuffle Master, Inc., Eden Prairie, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 651,117

[22] Filed: May 22, 1996

[51] Int. Cl.[6] ..... A63F 1/00

[52] U.S. Cl. ..... 273/292

[58] Field of Search ..... 273/292, 303, 273/274, 309

[56] References Cited

U.S. PATENT DOCUMENTS 5,288,077 2/1994 Jones ..... 273/292
5,577,731 11/1996 Jones ..... 273/292

OTHER PUBLICATIONS

Over/Under 13 Blackjack, Gaming Concepts Inc., 1988.
Super Suits Progressive Blackjack, Innovative Gaming Corporation of America, brochure obtained on Oct. 15, 1995 World Gaming Expo, Las Vegas.

*Primary Examiner*—Benjamin H. Layno
*Attorney, Agent, or Firm*—Craig J. Lervick

[57] ABSTRACT

A unique method for a wagering game is achieved by providing a side bet opportunity during the play of a Twenty-One game. The player is given the opportunity to place this side bet with the hope of receiving winnings when certain predetermined card configurations are received. Upon receipt of these defined card configurations, the player is immediately paid winnings during the process of the Twenty-One game. These additional winnings are based on sequences of cards and are independent and separate from wagers in the Twenty-One game. Additionally, all of the predetermined card configurations are preferably chosen such that they will not interfere with the underlying Twenty-One game. As a basis for paying out winnings, it is required that the player consecutively receive these certain card configurations during the play of the Twenty-One game after having made a bet in expectation of those card configurations appearing. Also, the final configuration of the Twenty-One hand is irrelevant to the side bet game as the players win immediately when the predetermined configurations are received, long before completion of the hand.

21 Claims, 2 Drawing Sheets

CONSECUTIVE CARD SIDE BET METHOD

BACKGROUND OF THE INVENTION

1. Field of the Invention

The present invention relates to a method of playing a wagering game utilizing standard rules and a standard deck of playing cards. More specifically, the method of the present invention is an enhancement to the game of Twenty-One, or Blackjack which creates an additional wagering opportunity for the players. In the process of the present invention, the players are given the opportunity to place an additional side bet, qualifying them for additional payments upon the receipt of designated strings of cards.

2. Background of the Art

Many different wagering games presently exist for use in both home and casino environments. Such games should necessarily be exciting, uncomplicated and easy to learn so as to avoid frustrating the players. Card games such as poker and Twenty-One have gained widespread popularity because of their established ranking of hands and well known rules. Furthermore, each of these games usually involve continuous wagering opportunities for the players thus increasing player participation and excitement. Lastly, the games move fairly quickly to maintain action and activity. All of these factors have created games which are widely accepted and widely known.

Wagering games have been described in many previous publications such as U.S. Pat. No. 5,364,105 and U.S. Pat. No. 5,288,077. Both of these patents outline the addition of a progressive jackpot component to a Twenty-One game wherein wagers are received for participation in this jackpot component and these wagers are accumulated over a period of time to create a large jackpot. Following completion of a hand, the players may win a jackpot payout based on the final hand received by the player.

Variations in wagering structures can also increase the excitement and acceptance of such wagering games. U.S. Pat. No. 5,417,430 discloses a poker game with an altered wagering scheme thus allowing the player the opportunity to compete for an additional prize or payout.

Other variations can be made to standard games to allow more player opportunity and involvement. U.S. Pat. No. 5,098,107 discloses a game wherein additional symbols are added to increase wagering opportunities. This allows the player the opportunity to place several wagers on different portions of the game while the game is being played. Somewhat similarly, U.S. Pat. No. 3,667,757 discloses a board game wherein the player is given choices regarding alternative strategies for play. Naturally the different strategies chosen have different payoff results. Unfortunately, this game is somewhat complicated and requires a considerable amount of time for the players to learn.

In the play of a Twenty-One game, there are many well understood strategies for players to follow. One publication outlining these strategies is Jerry L. Patterson and Eddie Olsen "Break the Dealer", 1986, Putnam Publishing Group. Generally, this strategy involves the player surveying their dealt cards, the dealer's displayed card, and making appropriate decisions based thereon. For example, if a player has a card total of eleven (11), the player should take a hit regardless of the dealer's displayed card. If, however, the player has a card total of twelve (12), the player should then consider the dealer's displayed card. A hit should be taken if the dealer's displayed card is a 2, 3, 7–10 or Ace. Other cards displayed by the dealer will suggest much different decisions by the player.

Some twenty-one tables offer a side bet game called "Over-Under" or some variation thereof. In addition to the normal markings on the table which are desirable for play of twenty-one (designated spaces for cards, designated spaces for bets, etc.), tables where Over-Under are played also have two additional designated areas for bets Usually the designated areas for the additional side bet is in the form of circles. Each circle identifies a specific bet, either "Over Thirteen" or "Under Thirteen." Before the turn of the first card in each hand of twenty-one, each player may place a bet as to whether the first two cards will total "Over Thirteen" or "Under Thirteen" by placing a bet in the appropriate circle. An amount of money equal to or less than the basic twenty-one wager may be placed in either circle. After the deal of the first two cards to each player, but before conclusion of the hand, wagers made on the side bet game of Over-Under have their wagers paid off or captured by the house. If the bet was Over Thirteen and the total of the cards was over thirteen, the house would pay equal odds on the wager. If the total count of the first two cards was thirteen or under, the house would capture the bet. Ties in this game (any total of thirteen) always allows the house to capture the bet. This side game has attained some level of acceptance and popularity, but payouts are limited to one-to-one ratios, with no special awards or multiplication of bets available to increase the excitement of the game.

In summary, it is desired to find a game that is easy to play and also fast moving. When the player is provided with a considerable amount of participation, and additional winnings based on card combinations not related to the base game, these games become much more strategic and enjoyable. Furthermore, a game is more exciting if a player feels anticipation and excitement from a number of different sources throughout the game.

SUMMARY OF THE INVENTION

The present method provides a player with the opportunity to place an additional wager or side bet while playing Blackjack or Twenty-One. In the process of playing the game, the player will initially place their normal wager for Blackjack or Twenty-One (hereinafter "base game"). Prior to dealing the cards, the player will also be given the opportunity to place a side bet, allowing them the possibility of winning a second amount based on the receipt of consecutive designated cards. The special ordering or designation for the cards may vary as the rules of the game are selected by the house. For example, wagers may be placed in anticipation of pairs of the same value or personification on the card (queens pair queens, but a king and queen, though of the same value, do not pair) or 'straights'. The bets on straights may be limited to increasing ranks of adjacent cards (e.g., 7 then 8) dealt in order, decreasing adjacent values of cards (e.g., queen then jack) dealt in order, or may combine the two in a single bet.

After all wagers have been made, dealing of the cards begins. As is customary in the play of Blackjack, the player is initially dealt two cards and the dealer is dealt two cards, one face up and one face down. In the preferred embodiment of the invention, the player's cards are dealt face up. However, this could vary depending upon the house rules. At this point, the dealer will stop to review the cards dealt. If the first card dealt to the player was a designated card, the player immediately wins a first winning amount. If the initial two cards dealt to the player creates a pair of designated cards (e.g., a pair of the same denomination of cards or a straight), a second winning amount is immediately won by the player. Play will continue according to the standard rules of the base game and the player will be paid winnings depending upon the number of consecutive designated cards received by the player during that round. Stated another way, the player will win depending upon the cards consecutively received by the player while playing the base game (i.e., not necessarily consecutively dealt from the deck).

In the preferred present game, the designated cards could be any desired combination of cards which are designated prior to play of the game. The designated cards should be determined, however, such that the play (or strategy) of the base game is unaffected until at a minimum after the fourth card has been dealt (e.g., four consecutive 3's). For example, strings of 2s (or a general bet for any pair) may be chosen as the designated cards for the side bet payout with payment up to six 2s. Similarly, 3s may be chosen as the designated cards with payment up to four 3s before basic strategy is affected. Other cards or combinations may also be chosen accordingly. The preferred game provies a single betting area where the play of the side bet is for both 2' and 3' as the 'target' card. That is, if this bet is made, if the first card down is either a two or three, the initial award for the side bet is made and the progressive game will continue for that card (either the two or the three, but not necessarily still for two's and three's at the discretion of the house). One concern which might be envisioned in the play of this side bet game is the emotional impact on other players at the table. It is common for players to be emotionally affected by other players taking what is considered to be unwarranted hits, as it might influence the cards being dealt to latter players, including the dealer. It is thought that when a player has reached a point where the consideration of an additional hit might influence his natural or analytic tendencies of basic strategy (e.g., a hand having four 3's which provides a payout of ~$1,000, with the possibility of the next three providing a payout of ~$10,000), the interest of the other players in seeing a big win at their table would tend to ameliorate any considerations of play generally thought to be inconsistent with conventional strategy.

It is an aspect of the present invention to provide a new and exciting wagering opportunity for players of Blackjack. This exciting and new wagering opportunity will allow for immediate winnings during the process of the game. It is a further aspect that these additional payouts will create anticipation and excitement while the cards are being dealt. This anticipation and excitement will exist as the players are looking forward to receiving their next card.

Another aspect of the present invention is to provide a side bet opportunity which does not interfere with the players' strategy in playing the base game. The designated cards are chosen such that the player will not be required to choose a playing strategy that is inconsistent with the generally accepted strategy of the base game.

It is a further aspect of the present invention to provide a side bet opportunity which will award the players winnings based on the receipt of consecutive cards by that player.

BRIEF DESCRIPTION OF THE DRAWINGS

Further objects and advantages of the present invention may be seen by reading the following detailed description in conjunction with the drawings in which.

DETAILED DESCRIPTION OF THE INVENTION

Figure 1:
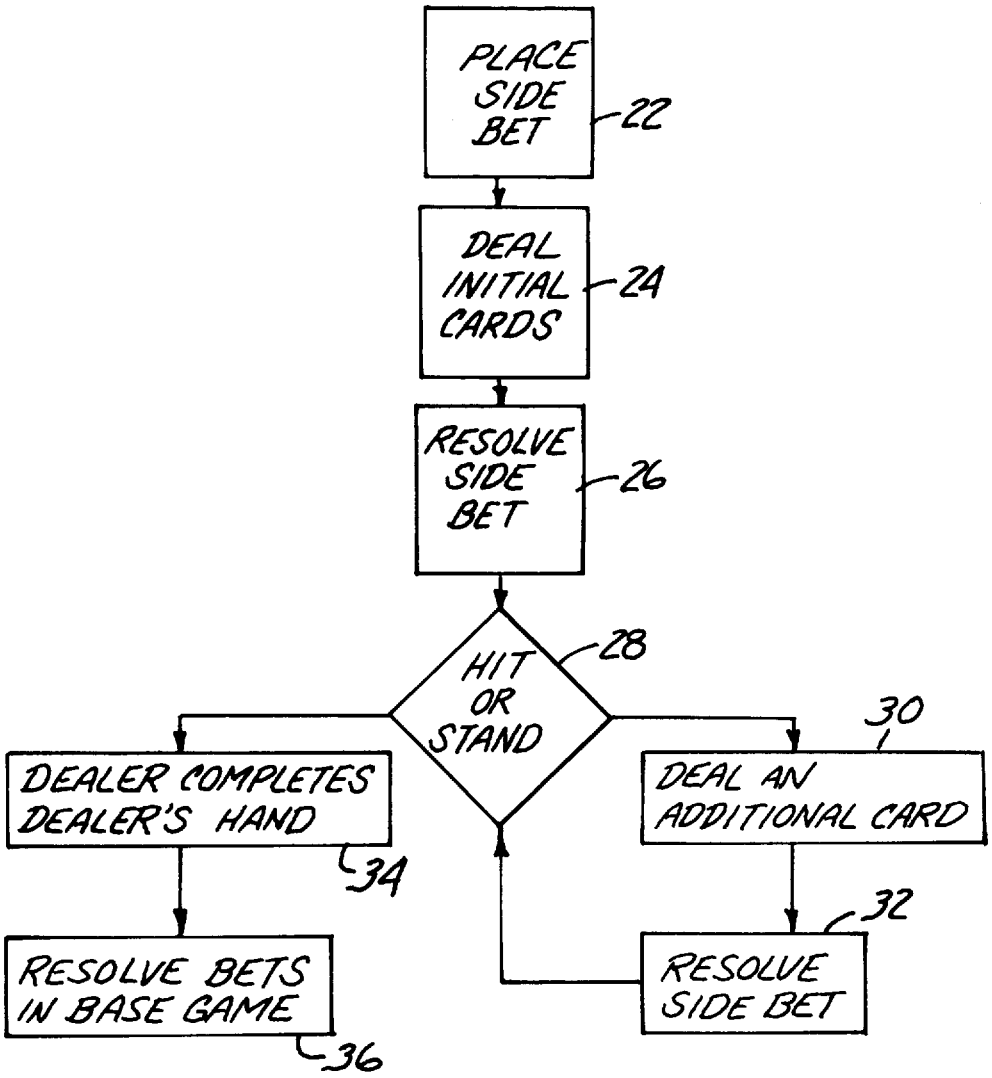
FIG. 1 is a flow chart outlining the side bet method of the present invention.

The method of the present invention provides a gaming participant with an additional wagering opportunity thus increasing the excitement of the game. More specifically, the method of the present invention provides a side bet opportunity for players while playing a standard game of Blackjack or Twenty-One (hereinafter a "Twenty-One game"). The method of the present invention provides payouts to the players for receiving certain sets of designated cards consecutively while playing Twenty-One. One example of an appropriate set of designated cards would provide for payment when the player receives a string of consecutive 2s. Several other sets of designated cards are equally possible, however, Referring to FIG. 1, there is shown a flow chart outlining the steps of the present wagering game. It is understood that all of these steps will take place while the players and dealer are situated at a standard gaming table, usually having special indicia on the playing surface for placement of the side bets. Additionally, the method of the present invention is generally carried out by having a house dealer handle all cards, although different dealing configurations are possible.

The method of the present invention will begin by a player placing a bet to participate in the Twenty-One game at step 20. This wager may consist of any monetary amount depending on the wagering limits set up by the gaming establishment. The player is then given the opportunity to place a side bet in step 22. While these two steps are shown sequentially, both of these bets could actually be made at the same time. In order to participate in the side bet, however, the wager of step 20 is required (i.e., a player must participate in the base game and cannot simply play the side bet).

In step 24, the play of the game begins by the dealer dealing the initial cards. As is customary in the game of Twenty-One, two cards are dealt face up to each of the players, while two cards are dealt to the dealer—one face up and one face down.

In step 26, the initial round of side bets is resolved. Specifically, if the player has received a designated card or cards in their initial cards, the player will win an amount according to a predetermined schedule. In one embodiment of the invention, the designated cards are identified to be strings of 2s. In this embodiment, if the player receives a 2 for their first card, the player will win a first payout amount. If this player then receives a second 2 as their second card (thus creating a pair of 2s in their initial cards), the player will win a second payout amount. At this point in the game, only two cards have been dealt, therefore, resolution of the side bet will be based on only these first two cards. In the above example where the player has received a pair of 2s for their initial cards, the player would have won both the first payout amount and the second payout amount at this point. It will be recognized that many other predetermined card designations could be used for the present game and the use of 2s in the above example is merely for explanatory purposes. Also, it is noted that the payout amounts are cumulative so that once a player receives a winning hand, their winnings will be added to any further winnings.

Following the initial resolution of side bets in step 26, the player is then asked whether they would like another card (take a hit) or would like to stay with the cards as dealt. Also, the player is given other options at this point, including "splitting" cards or "doubling down". Each of these options are well known by Twenty-One players and will eventually require the player to take another card. If the player decides to take a hit in step 28, the dealer will deal an additional card to the player in step 30. Following the deal of this additional card, the side bet will again be resolved in step 32. (Specifically, the cards received will be compared with the designated cards to determine if the player has won.) If the third card received (whether split or not) is in the designated string of cards, the player will win a third winning amount. Using the above-mentioned example wherein payout is made for consecutive 2s, the player will win the third payout amount if they have received a pair of 2s in the initial deal and have also received a third 2 when they took their first hit. Stated another way, the player will win the third payout amount if they receive three consecutive 2s as their first three cards.

The consecutive card side bet game of the present invention may be played on a single bet at only one player position. That is, if a single person is playing multiple positions, each hand being played by the single player will have or not have a bet for the side game as the player wants for each hand. A single player playing multiple hands can not have consecutive cards at different playing positions considered in the consecutive side bet game. That is, if at the first position the player playing multiple positions concludes his play of one hand with a hit of a 2, the initial hit on the next consecutive position will not be considered a consecutive hit as it is not within a single played hand. Another aspect of the play of the side bet game is that for reasons of realism and probability, the game should be played with at least a four-deck shoe. A single-deck shoe would allow only four possible 2's or 3's (without even considering the dealers cut-off of the last cards in the shoe to reduce the impact of card counting), while a four-deck shoe would offer more significant opportunities for a sufficient number of 2's and 3's (and other cards in less preferred games) to be in play in the shoe.

The house may establish rules for the play of the consecutive card side bet game of the present invention in the event of a twenty-one by the dealer. The two ways of house play at present are a) a view by the dealer of the first two cards (with allowance of time for 'Insurance' if an ace is shown by the dealer) with Black-Jacks displayed before players can take hits, or b) allowance of play of the game, with all players taking hits as desired and the dealer examining his cards only after the cessation of hits by the other players. In the first option, the house may choose from among 1) side bets captured by a Black-Jack, 2) side bets are a draw against a Black-Jack, or 3) those players with side bets in play may continue, but all other players are out of the play. In the second option, the players side bets would almost certainly have to kept in play and paid out.

It is also to be noted that the term 'dealer' is not intended to be limited to an animate dealer in the practice of the present invention. The dealer may be a mechanical device, virtual device or programmed dealing means, as in video black-jack games. The dealer may also include a mechanical or human dealer in combination with a mechanical shuffler. To avoid excessive payouts, the house or promoter of the side bet game might well prefer mechanical shuffling systems, such as those manufcatured by Shuffle Master, Inc. Quality dealing machines can avoid channeling or grouping of cards which an astute player might be able to track through replay of shoes.

After the side bet opportunity has again been resolved in step 32, the method of the present game will loop back to step 28 where the player will again be asked if they would like to hit or stand. If the player chooses to hit once again, the process moves back to step 30 where the dealer will deal an additional card and then to step 32 where the side bet will again be resolved. If the player's cards continue to follow the designated set or pattern of cards, the player will win a fourth winning amount. Again using the above example, if the fourth card received by the player is a fourth consecutive 2, the player will then win the fourth payout amount. The process then loops back to step 28 where the player is again asked to hit or stand.

As can be seen, this loop of steps (steps 28, 30 and 32) could continue for an indefinite number of rounds, depending upon the cards received by the players. As will also be seen, the player will not always be paid in step 32 if their cards do not meet the requirements of the designated set of cards. Also as is well known in the game of Twenty-One, this loop will end if the player breaks or busts (receiving a card total over 21).

If at step 28 the player decides to stand, the method of the present wagering game moves on to step 34 wherein the dealer will complete the hand. More specifically, the dealer will deal the remaining house cards according to well-established house rules. In most cases this involves dealing cards to the dealer's hand such that hits are taken anytime the card total is 16 or under, while standing with any card total equaling 17 or better.

The game description above involves a situation wherein the player and the dealer are the only two individuals participating in a hand of Twenty-One. It is understood and contemplated, however, that the side bet of the present invention could be played simultaneously by numerous players. In this situation, time delays may occur in the dealing sequence while cards are dealt to other players. For example, each player will have the opportunity to play their cards (go through steps 28 through 32) before the dealer completes the hand in step 34. From the perspective of any one player, however, the sequence will be the same as described and shown in FIG. 1.

Following the completion of the Twenty-One hand, the method of the present game moves on to step 36 in which all bets are resolved in the Twenty-One game. As is also well known by those skilled in the art of Twenty-one, this resolution includes payouts for all players who have a card total exceeding that of the dealer while also staying under a card total of 21.

Figure 2:
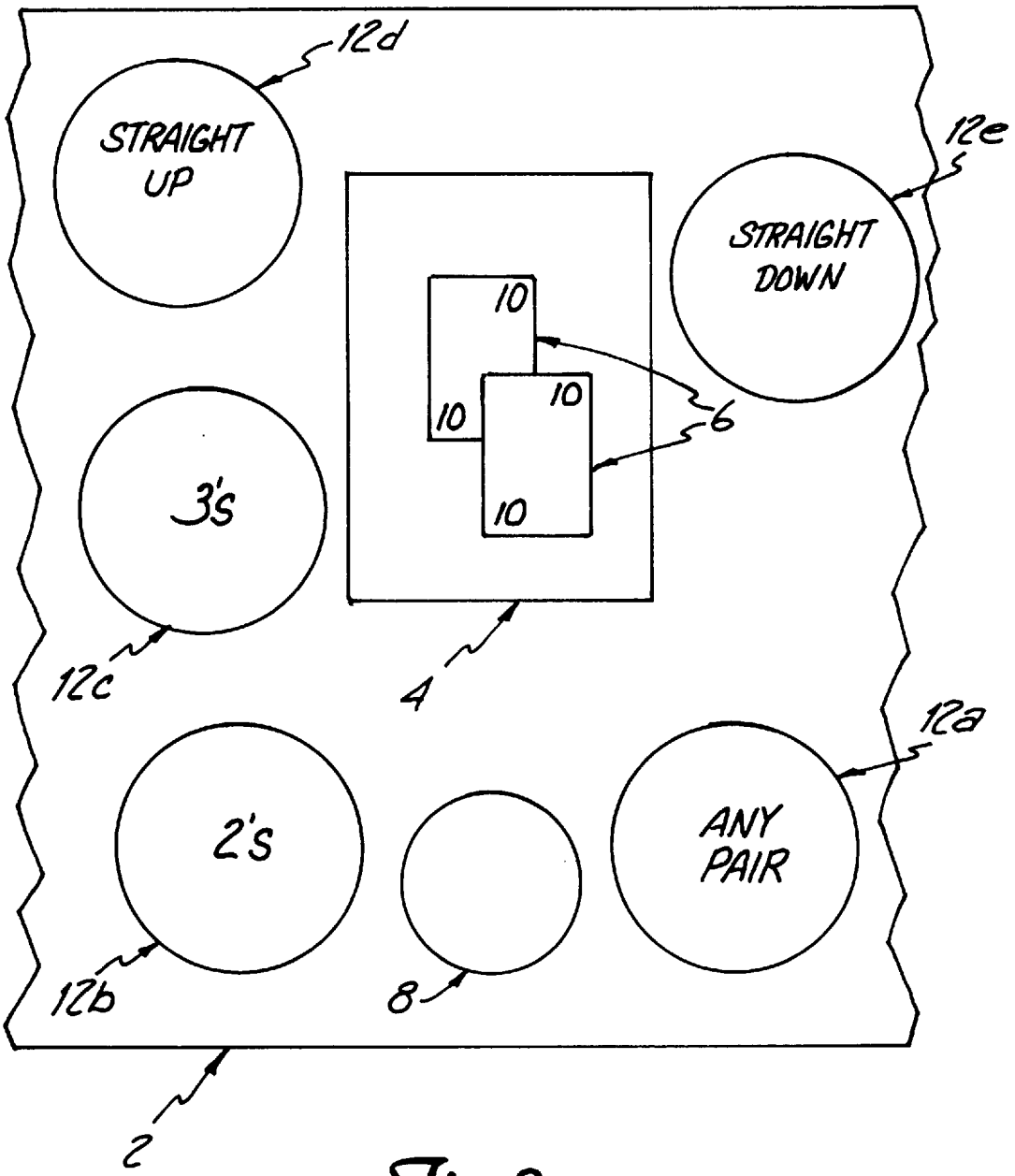
FIG. 2 is a top view from the dealer's side of the table (not shown) of a segment 2 of the table top assigned to a single player.

FIG. 2 shows an individual player's section 2 of a playing surface for twenty-one coupled with a side bet game according to the present invention. The standard card play area 4 for receiving cards 10 and the base game (twenty-one) betting area 8 are present. Other portions of the individual player's area 2 may have other various bet designation areas 12*a*–12*e* drawn or printed onto the playing surface. These various bet designation areas indicate the type of wager being placed by the player. Any one or combination of bet designation areas 12*a*, 12*b*, 12*c*, 12*d*, 12*e* may be present within the individual player's area 2. One or more of the side bets may be made prior to the deal of the first card in each hand by placing the appropriate wager in a bet designation area 12*a*–12*e*. Side bet area 12*a* indicates a side bet for any pair. Side bet area 12*b* indicates a side bet specifically for sequences of 2s. Side bet area 12*c* indicates that a side bet specifically for sequences of 3s is being made. Side bet area 12*d* indicates that a specific bet for sequences of cards in ascending order is being made (e.g., first a seven and then an eight). Side bet area 12*e* indicates that a bet specific for sequences of cards in descending order is being made (e.g., first a six and then a five). Wagers for the sequences of cards in ascending or descending order may be continued for another card with increasing payoffs as long as the next card in the sequence will not automatically break the player (e.g., the sequence may be continued with the first two cards being a six then a seven, but wagering on the sequence can not be continued if the first two cards were a nine and an eight).

These types of games practiced within the scope of the present invention are readily distinguished from such games as Over-Under. The present games require a sequencing of cards, either by pairs, suits, or ascension or decline in adjacent values (straight). Games such as Over-Under still rely on value totals for the cards dealt as the defining value for winning or loosing. The term 'sequence' or 'sequence of cards' in the practice of this invention means a relationship between consecutive cards which is primarily independent of the total value of the cards dealt to a single player.

In the present embodiment the player will win the predetermined winning amounts immediately upon receiving appropriate cards. While these amounts are won upon receipt of these cards, for the convenience of the dealers payment may not be made until the end of the hand. For example, in the above embodiment involving 2s, when a player has received a pair of 2s in the initial deal, they have already won the first payout amount and the second payout amount. Play of the cards will then be completed and the dealer will then award the player their winnings. Similarly, winnings for all winning combinations will be awarded after completion of the hand.

In an alternative embodiment involving payouts for 2s, additional payments will be made immediately upon receipt of consecutive 2s, regardless of how the underlying Twenty-One game progresses. For example, when a player has received a pair of 2s as their initial two cards and then takes a "hit", thus receiving a third 2, play stops and the player is paid. In this embodiment, all payouts would be made before completion of the underlying Twenty-one game. Additionally, standard payouts are made according to the outcome of the underlying Twenty-One game.

In one embodiment of the invention, the winnings for receipt of consecutive 2s by a player, based again on a $1.00 side bet, could be as follows:

| Winning Combinations | Payout Amount |
|---|---|
| (Consecutively Received) | |
| 1-2 | $1.00 |
| 2-2s | 20.00 |
| 3-2s | 100.00 |
| 4-2s | 1,000.00 |
| 5-2s | 10,000.00 |
| 6-2s | 1,000,000.00 |

Stated differently, the payouts may be more generally described as follows:

| Winning Combinations | Payout |
|---|---|
| (Consecutively Received starting with the first card dealt) | |
| 1-2 | $A |
| 2-2s | B |
| 3-2s | C |
| 4-2s | D |
| 5-2s | E |
| 6-2s | F |

wherein A is a first predetermined amount, B is a second predetermined amount, C is a third predetermined amount, D is a fourth predetermined amount, E is a fifth predetermined amount, and F is a sixth predetermined amount. The predetermined amounts could be specified dollar values, as shown in the first schedule, or could be multiples of the player's wager.

As can be seen from the above payout schedules, predetermined amounts are paid to the players depending on the receipt of consecutive 2s in their hand. The winning arrangement are chosen as above because such arrangements will not adversely affect players' decisions while playing the base game. As can be seen, if a player has five 2s in their hand (card total of 10), they will naturally hit that hand while playing the base game. Thus, the player is never required to choose a playing strategy in the preferred side bet game (with only 2's and 3's in play for consecutive cards) which is inconsistent with the player's basic strategy in the base game, until in the play of the preferred side bet game a fourth three has been dealt. For example, if a player has a card total of twelve (12) while playing the base game, the player will be required to make a strategic decision regarding whether to take another card or not. In the present invention, this strategic decision will be unaffected by the play of the side bet.

Combinations of consecutive 3s are also appropriate as winning combinations with payouts for up to four 3s. (Anything over four 3s could affect the basic strategy when playing the base game.) The concept of using 3s is the same as that using 2s wherein these hand combinations are calculated such that they will not adversely affect the basic strategy of the base game. Similarly, a string of up to three 4s, two 5s or two 6s would also fall within the scope of the present invention because these combinations would not affect the player's strategic decisions in the base game.

Several basic strategies exist in the play of the base game. Generally, these strategies all call for a player to take a hit when their card total is eleven (11) or less. If a player has a card total of twelve (12) or more, several other factors must be considered by the player in making their decision. For example, if the player has a card total of twelve (12) and the dealer has a ten (10) showing, basic strategy says the player should take a hit. If the player has a twelve (12), however, and the dealer has a five (5) showing, basic strategy says the player should stand. In summary, most of the player's strategic decisions are necessary once a player's card total reaches twelve (12) or more.

The motivating concept of this side bet is to provide the players with an additional wagering opportunity wherein very large payouts are possible. Also, the side bet provides a mechanism to create additional excitement when playing the base game. Again, the payout schedules for the preferred side bet game limited to 2's and 3's provided are calculated such that they will not affect players' decisions while playing the base game except in about one hand per thousand dealt.

The payout schedule is calculated based on the probability of players receiving these hands, the estimated number of players participating, the required expenses for the casino to offer the side bet opportunity, and the desired profit levels. From all this information, appropriate payouts are calculated and advertised as predetermined amounts to be paid upon receipt of appropriate hands.

Numerous card designations are possible for the wagering game of the present invention. As previously mentioned, the use of consecutive 2s or 3s will provide a very exciting side bet opportunity. Additionally, the use of up to three 4s, up to two 5s and up to two 6s is equally possible. Each of these designated card sets are chosen such that their configuration will not affect the play of the base game. For example, any time a player has received five 2s (a card amount totaling ten), they will not be motivated to utilize a strategy to optimize their side bet. More specifically, they would naturally take a hit in the play of the Twenty-One game. Any card total above this would affect the players' decisions. For example, if a player has six 2s and is given the opportunity for payouts at seven 2s, they must then decide whether they want to risk a strategic decision in the Twenty-One game to optimize their winning opportunities in the side bet game.

Strings of like cards have been suggested above as appropriate combinations for winning hands. Other combinations such as continuous runs, three card flushes, etc. could also be used by the present method.

A number of characteristics make the present game very exciting and enticing for the players. Obviously there is the opportunity to win large amounts of money in addition to the amount won in the base game. As can be seen in the first embodiment of this invention, the receipt of one particular hand configuration (a collection of six consecutive 2s) could pay over a million dollars based on a single $1.00 bet.

Secondly, the present game creates excitement and anticipation while the cards are being dealt to the players. As the player is playing, they will initially watch for the first card received and then anticipate receipt of additional cards during the deal.

Lastly, the side bet is won by the players immediately upon receipt of appropriate cards. Thus the player is not required to wait until completion of the game to determine if they have won additional amounts.

While the present method has been described in the context of a live casino table game, this method is equally applicable to other presentations. For example, the method of the present wagering game could be easily carried out by a video machine having a display and interactive buttons. In this embodiment, the video machine would have a video screen which would display all cards to the players. The player could then use the interactive buttons to make "hit or stand" decisions.

Additionally, as other technologies become increasingly available, this game could be adapted for use in other arenas. One common example of this is the use of the present wagering game as a computer video game. This game could take the form of a CD ROM or computer diskette which is loaded into a standard personal computer. Further, the game could be incorporated into a handheld game system which would allow portable play in numerous different locations. Lastly, other types of installed computerized systems could be configured to carry out the method of the present game such as display systems on aircraft or busses etc.

The above -mentioned method can be altered in a specific configuration without departing from the principles of the invention. We claim all modifications coming within the scope and spirit of the following claims.

It is claimed:

1. A method of providing an additional wagering opportunity in a casino game which utilizes standard playing cards, comprising the steps of:

(a) a player making a first wager to participate in the casino game;

(b) a player optionally making a second wager to participate in a side bet that a predetermined sequence of cards will be dealt to the player, wherein participation in the side bet will not interfere with a player's strategy in the casino game;

(c) a dealer dealing a plurality of cards to the player;

(d) if the dealing of the plurality of cards follows a predetermined sequence of cards, the player wins a predetermined amount, wherein the predetermined sequence of cards includes dealing consecutive cards of equal value, each card having an individual value of between two and five, and the combined value of the predetermined sequence is less than twelve; and (e) the dealer completing the play of the game.

2. The method of claim 1 wherein prior to the dealer completing the player's hand, the method further comprises the steps of:

(a) questioning the player regarding his desire to receive additional cards;

(b) if the player desires to receive additional cards, the dealer dealing additional cards to the player, thus creating a second portion of the player's hand; and (c) if the dealing of the second portion of the player's hand continues to follow the predetermined sequence of cards, the player wins an additional predetermined amount.

3. The method of claim 2 wherein the casino game is Twenty-One.

4. The method of claim 1 wherein the predetermined sequence of cards includes a consecutive string of 2s beginning with the first card received.

5. The method of claim 1 wherein the sequence of cards is selected from the group consisting of pairs, straights, and flushes.

6. The method of claim 1 wherein the predetermined sequence of cards includes only any consecutive string of 2s or 3s beginning with the first card received.

7. The method of claim 6 wherein the consecutive string of 3s does not exceed four 3s and the consecutive string of 2s does not exceed six 2s.

8. The method of claim 1 wherein the predetermined sequence of cards and predetermined amounts are selected from the group of tables selected from the group consisting of:

| Winning Combinations (Consecutively Received starting with the first card dealt) | Payout |
|---|---|
| 1-2 | $1.00 |
| 2-2s | 20.00 |
| 3-2s | 100.00 |
| 4-2s | 1,000.00 |
| 5-2s | 10,000.00 |
| 6-2s | 1,000,000.00 |
| 1-3 | $1.00 |
| 2-3s | 20.00 |
| 3-3s | 100.00 |
| 4-3s | 1,000.00 |
| 5-3s | 10,000.00 |
| 6-3s | 1,000,000.00 |
| 1-4 | $1.00 |
| 2-4s | 20.00 |
| 3-4s | 100.00 |
| and | |
| 1-5 | $1.00 |
| 1-6 | 1.00 |
| 2-5s | 20.00 |
| 2-6s | 20.00 |

9. The method of claim 8 wherein the first predetermined amount, the second predetermined amount, the third predetermined amount, the fourth predetermined amount, the fifth predetermined amount, and the sixth predetermined amount are fixed dollar amounts.

10. The method of claim 8 wherein the first predetermined amount, the second predetermined amount, the third predetermined amount, the fourth predetermined amount, the fifth predetermined amount, and the sixth predetermined amount are multiples of the second wager.

11. The method of claim 1 wherein the predetermined sequence of cards and predetermined amounts are selected from the group of tables selected from the group consisting of:

| Winning Combinations (Consecutively Received starting with the first card dealt) | Payout |
|---|---|
| 1-2 | $A |
| 2-2s | B |
| 3-2s | C |
| 4-2s | D |
| 5-2s | E |
| 6-2s | F |

wherein A is a first predetermined amount, B is a second predetermined amount, C is a third predetermined amount, D is a fourth predetermined amount, E is a fifth predetermined amount, and F is a sixth predetermined amount, wherein F>E>D>C>B>A,

| Winning Combinations (Consecutively Received starting with the first card dealt) | Payout |
|---|---|
| 1-3 | $A |
| 2-3s | B |
| 3-3s | C |
| 4-3s | D |
| 5-3s | E |
| 6-3s | F |

wherein A is a first predetermined amount, B is a second predetermined amount, C is a third predetermined amount, D is a fourth predetermined amount, E is a fifth predetermined amount, and F is a sixth predetermined amount, wherein F>E>D>C>B>A,

| Winning Combinations (Consecutively Received starting with the first card dealt) | Payout |
|---|---|
| 1-4 | $A |
| 2-4s | B |
| 3-4s | C |

wherein A is a first predetermined amount, B is a second predetermined amount, and C is a third predetermined amount, wherein C>B>A, and

| Winning Combinations (Consecutively Received starting with the first card dealt) | Payout |
|---|---|
| 1-5 | $A |
| 1-6 | A |
| 2-5s | B |
| 2-6s | B |

wherein A is a first predetermined amount, and B is a second predetermined amount, wherein B>A.

12. A method of providing an additional wagering opportunity to a player while they participate in a casino wagering game utilizing standard playing cards, the method comprising the steps of:

(a) a player making a first wager to participate in the wagering game;

(b) the player optionally making a second wager to participate in the additional wagering opportunity that a predetermined sequence of cards will be dealt to the player, wherein participation in the second wager will not interfere with a player's strategy in the wagering game;

(c) a dealer dealing a set of initial cards to the player and a set of initial cards to the dealer;

(d) if the dealing of the set of initial cards follows a predetermined sequence of cards, the player wins a predetermined amount, wherein the predetermined sequence of cards includes dealing consecutive cards of equal value, each card having an individual value of between two and five, and the combined value of the predetermined sequence is less than twelve or equal to twelve;

(e) the dealer completing the player's hand thus forming a final player's hand having a player's card total, and if, in the process of completing the player's hand, the player receives additional cards which continue to follow the predetermined sequence of cards, the players win a further predetermined amount;

(f) the dealer completing a dealer's hand thus forming a final dealer's hand having a dealer's card total; and (g) if the player's card total exceeds the dealer's card total, and the player's card total is twenty-one or less, the player winning a base game winning amount.

13. The method of claim 12 wherein the casino game is Twenty-One.

14. The method of claim 12 wherein the predetermined sequence of cards includes a wager inclusive of only any consecutive string of 2s or 3s beginning with the first card dealt.

15. The method of claim 12 wherein the predetermined sequence of cards includes a wager inclusive of only any consecutive string of 2s and 3s beginning with the first card dealt.

16. The method of claim 12 wherein the sequence of cards is selected from the group consisting of pairs, straights and flushes.

17. A method of providing an additional wagering opportunity to a player while they participate in a wagering game utilizing standard playing cards, the method comprising the steps of:

(a) a player making a first wager to participate in the wagering game;

(b) the player optionally making a second wager to participate in the additional wagering opportunity that a predetermined sequence of cards will be dealt to the player;

(c) a dealer dealing a set of initial cards to the player and a set of initial cards to the dealer;

(d) if the dealing of the set of initial cards follows a predetermined sequence of cards, the player wins a predetermined amount;

(e) the dealer completing the player's hand thus forming a player's final hand having a player's card total, and if, in the process of completing the player's hand, the player receives additional cards which continue to follow the predetermined sequence of cards, the player wins a further predetermined amount;

(f) the dealer completing a dealer's hand thus forming a dealer's final hand having a dealer's card total; and (g) if the player's card total exceeds the dealer's card total, and the player's card total is twenty-one or less, the player winning a base game winning amount;

wherein the predetermined sequence of cards and predetermined amounts are selected from the group of tables selected from the group consisting of:

| Winning Combinations (Consecutively Received starting with the first card dealt) | Payout |
|---|---|
| 1-2 | $1.00 |
| 2-2s | 20.00 |
| 3-2s | 100.00 |
| 4-2s | 1,000.00 |
| 5-2s | 10,000.00 |
| 6-2s | 1,000,000.00 |
| 1-3 | $1.00 |
| 2-3s | 20.00 |
| 3-3s | 100.00 |
| 4-3s | 1,000.00 |
| 1-4 | $1.00 |
| 2-4s | 20.00 |
| 3-4s | 100.00 |
| 1-5 | $1.00 |
| 1-6 | 1.00 |
| 2-5s | 20.00 |
| 2-6s | 20.00 |
| 1-2 | $A |
| 2-2s | B |
| 3-2s | C |
| 4-2s | D |
| 5-2s | E |
| 6-2s | F |

wherein A is a first predetermined amount, B is a second predetermined amount, C is a third predetermined amount, D is a fourth predetermined amount, E is a fifth predetermined amount, and F is a sixth predetermined amount, wherein F>E>D>C>B>A,

| Winning Combinations (Consecutively Received starting with the first card dealt) | Payout |
|---|---|
| 1-3 | $A |
| 2-3s | B |
| 3-3s | C |
| 4-3s | D |

wherein A is a first predetermined amount, B is a second predetermined amount, C is a third predetermined amount, and D is a fourth predetermined amount, wherein D>C>B>A,

| Winning Combinations (Consecutively Received starting with the first card dealt) | Payout |
|---|---|
| 1-4 | $A |
| 2-4s | B |
| 3-4s | C |

wherein A is a first predetermined amount, B is a second predetermined amount, and C is a third predetermined amount, wherein C>B>A,

| Winning Combinations (Consecutively Received starting with the first card dealt) | Payout |
|---|---|
| 1-5 | $A |
| 1-6 | A |
| 2-5s | B |
| 2-6s | B |

wherein A is a first predetermined amount, and B is a second predetermined amount, wherein B>A.

18. A method of providing an additional wagering opportunity to a player while they participate in a casino wagering game utilizing standard playing cards, the method comprising the steps of:

(a) a player making a first wager to participate in the wagering game;

(b) the player optionally making a second wager to participate in the additional wagering opportunity that a predetermined sequence of cards will be dealt to the player, wherein participation in the additional wagering opportunity will not interfere with a player's strategy in the wagering game;

(c) a dealer dealing a set of initial cards to the player;

(d) if the dealing of the set of initial cards follows a predetermined sequence of cards, the player wins a predetermined amount, wherein the predetermined sequence of cards includes dealing consecutive cards of equal value, each card having an individual value of between two and five, and the combined value of the predetermined sequence is less than twelve;

(e) the dealer questioning the player as to whether the player would like an additional card;

(f) if the player would like an additional card, the dealer dealing an additional card to the player and if the dealing of the player's initial cards and additional card follow a predetermined sequence of cards, the player wins a second predetermined amount and repeats this step; and (g) if the player would not like an additional card, the dealer completes the wagering game and resolves the first wager.

19. The method of claim 18 wherein the casino game is Twenty-One.

20. The method of claim 18 wherein the predetermined sequence of cards includes a wager made on only any consecutive string of 2s and/or 3s beginning with the first card dealt.

21. A method of providing an additional wagering opportunity to a player while they participate in a wagering game utilizing standard playing cards, the method comprising the steps of:

(a) a player making a first wager to participate in the wagering game;

(b) the player optionally making a second wager to participate in the additional wagering opportunity that a predetermined sequence of cards will be dealt to the player;

(c) a dealer dealing a set of initial cards to the player;

(d) if the dealing of the set of initial cards follows a predetermined sequence of cards, the player wins a predetermined amount;

(e) the dealer questioning the player as to whether they would like an additional card;

(f) if the player would like an additional card dealt the dealer dealing an additional card to the player and if the dealing of the player's initial cards and additional card follow a predetermined sequence of cards, the player wins a second predetermined amount and repeats this step; and (g) if the player would not like an additional card dealt the dealer completes the wagering game and resolves the first wager;

wherein the predetermined sequence of cards and predetermined amounts are selected from the group of tables selected from the group consisting of:

| Winning Combinations (Consecutively Received starting with the first card dealt) | Payout |
|---|---|
| 1-2 | $1.00 |
| 2-2s | 20.00 |
| 3-2s | 100.00 |
| 4-2s | 1,000.00 |
| 5-2s | 10,000.00 |
| 6-2s | 1,000,000.00 |
| 1-3 | $1.00 |
| 2-3s | 20.00 |
| 3-3s | 100.00 |
| 4-3s | 1,000.00 |
| 1-4 | $1.00 |
| 2-4s | 20.00 |
| 3-4s | 100.00 |
| 1-5 | $1.00 |
| 1-6 | 1.00 |
| 2-5s | 20.00 |
| 2-6s | 20.00 |
| 1-2 | $A |
| 2-2s | B |
| 3-2s | C |
| 4-2s | D |
| 5-2s | E |
| 6-2s | F |

wherein A is a first predetermined amount, B is a second predetermined amount, C is a third predetermined amount, D is a fourth predetermined amount, E is a fifth predetermined amount, and F is a sixth predetermined amount, wherein F>E>D>C>B>A,

| Winning Combinations (Consecutively Received starting with the first card dealt) | Payout |
|---|---|
| 1-3 | $A |
| 2-3s | B |
| 3-3s | C |
| 4-3s | D |

wherein A is a first predetermined amount, B is a second predetermined amount, C is a third predetermined amount, and D is a fourth predetermined amount, wherein D>C>B>A,

| Winning Combinations (Consecutively Received starting with the first card dealt) | Payout |
|---|---|
| 1-4 | $A |
| 2-4s | B |
| 3-4s | C |

wherein A is a first predetermined amount, B is a second predetermined amount, and C is a third predetermined amount, wherein C>B>A,

| Winning Combinations (Consecutively Received starting with the first card dealt) | Payout |
|---|---|
| 1-5 | $A |
| 1-6 | A |
| 2-5s | B |
| 2-6s | B |

wherein A is a first predetermined amount, and B is a second predetermined amount, wherein B>A.

* * * * *